US006270532B1

(12) United States Patent
Hölz et al.

(10) Patent No.: US 6,270,532 B1
(45) Date of Patent: Aug. 7, 2001

(54) ELEMENT FOR WASHING OR TREATING A YARN OR SIMILAR STRUCTURE WITH A FLUID

(75) Inventors: Winfried Hölz, Hausen; Heinz-Dieter Bauer, Erlenbach; Hans-Dieter Kiaubs, Johannesberg, all of (DE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/380,402

(22) PCT Filed: Mar. 19, 1998

(86) PCT No.: PCT/EP98/01782

§ 371 Date: Sep. 9, 1999

§ 102(e) Date: Sep. 9, 1999

(87) PCT Pub. No.: WO98/45513

PCT Pub. Date: Oct. 15, 1998

(30) Foreign Application Priority Data

Apr. 4, 1997 (EP) ..... 97200986

(51) Int. Cl.[7] ..... D06B 5/06

(52) U.S. Cl. ..... 8/151.2; 68/181 R

(58) Field of Search ..... 8/151.2; 68/181 R, 68/200; 118/420; 28/255, 272, 273, 276

(56) References Cited

U.S. PATENT DOCUMENTS

| | | | | |
|---|---|---|---|---|
| 2,844,019 | | 7/1958 | Schurmann et al. . | |
| 3,474,615 | * | 10/1969 | Irwin et al. | 28/272 X |
| 3,581,486 | * | 6/1971 | Dibble | 28/276 X |
| 3,771,306 | * | 11/1973 | Ostrowski et al. | 28/272 X |
| 4,298,565 | | 11/1981 | Yang . | |
| 4,453,298 | | 6/1984 | Nabulon et al. . | |
| 4,724,588 | * | 2/1988 | Runkel | 28/255 |

FOREIGN PATENT DOCUMENTS

| | | | | |
|---|---|---|---|---|
| 560937 | * | 10/1932 | (DE) | 68/200 |
| 82534 | * | 6/1971 | (DE) | 68/181 R |
| 1155062 | * | 6/1969 | (GB) | 28/272 |

* cited by examiner

*Primary Examiner*—Philip R. Coe
(74) *Attorney, Agent, or Firm*—Oliff & Berridge, PLC

(57) ABSTRACT

The invention pertains to an element (21) for washing or treating a yarn or similar structure with a fluid, the element comprising a cavity (23) for guiding the yarn and at least one fluid jet (26) for directing the fluid into the yarn, characterised in that the cavity (23) is tube-shaped and communicates with the outside of the element (21) via a slot (24). With the said element the formation of aerosel is avoided and the consumption of fluid is halved.

19 Claims, 1 Drawing Sheet

ELEMENT FOR WASHING OR TREATING A YARN OR SIMILAR STRUCTURE WITH A FLUID

BACKGROUND OF THE INVENTION

The invention pertains to an element for washing or treating a yarn or similar structure with a fluid, the element comprising a cavity for guiding the yarn and at least one fluid jet for directing the fluid into the yarn.

Such a washing element is known from WO 93/06266, which describes how the exchange of mass and heat between a yarn and a washing fluid can be improved by jetting the fluid into the yarn. As a result of the enhanced exchange, the time needed for washing the yarn is reduced and the machinery involved can be smaller.

However, due to the use of the jet or jets and/or the high speeds of the yarn utilized in modern equipment, the washing fluid is disturbed to such an extent that the formation of a spray or aerosol of the washing fluid, which normally contains the substances that have been washed out of the yarn, is unavoidable. The aerosol seriously contaminates the working environment and the equipment itself. Especially when aggressive materials are involved, which is often the case, for instance in the production of aramid yarn (sulphuric acid) or cellulose yarn (phosphoric acid), the contamination poses a considerable threat to both personnel and equipment and makes it necessary to implement several expensive and impractical safety measures.

Another problem encountered during the washing or treating of yarns is the consumption of washing or treating fluid. A washing fluid containing, e.g., sulphuric acid removed from an aramid yarn usually needs further processing before it can be re-used or discharged, which always incurs additional costs. Therefore, the amount of fluid used in the washing or treating process should be as low as possible and the mass transfer to the fluid should be as effective as possible.

SUMMARY OF THE INVENTION

It is an object of the present invention to reduce or even avoid the formation of aerosol and to reduce the consumption of washing or treating fluid and increase the effectiveness of the mass-transfer to the fluid. This object and additional advantages that will be explained herein below are achieved by an element as described in the first paragraph above where the said, cavity is (substantially) tube-shaped and communicates with the outside of the element via a slot.

Surprisingly, it was found that the formation of aerosol thus can be virtually obviated due to the water from the jets which builds a water column or bath being confined in the slot, which prevents the formation of droplets and aerosol in the vicinity of the jets. Further, it appeared that the fluid consumption could be reduced by approximately half without decreasing the effectiveness of the washing or treatment of the yarn.

It is preferred that the slot runs the length of the cavity. Thus there are no obstacles which prevent the filament from entering the cavity through the slot, and spinning in becomes easy and can be carried out quickly and automatically. The spinning in (also referred to as threading in or lacing up) of the filament in the element can be further enhanced by using a slot that diverges near the outside of the element. That way, the opening for the filament to enter the element is more accessible.

It is also preferred that the element according to the invention comprises two jets making a sharp angle (smaller than 90 degrees) with one another, thus allowing a compact design of the element.

In order to allow the water column or bath inside the slot to have sufficient height, the slot should be relatively narrow. For most fluids it is preferred that the slot has a width in the range from 0.3 to 4 mm. However, the optimal width is dependent on the surface tension of the fluid used and, therefore, in some instances the optimal width may be larger than the said 4 mm. Further, the length of the slot and/or the cavity preferably exceeds 8 mm, the range from 20 mm to 100 mm being most preferred, while the height of the slot preferably exceeds 10 mm, the range from 15 mm to 40 mm being most preferred.

In an advantageous embodiment, the tubular cavity effectively has a cross-section that is V-shaped with the vertex of the V pointing away from the jets, which, as stated above, preferably make a sharp angle with one another. Thus, the water exiting the jets pushes the filament towards the vertex and guarantees that it remains in the same position.

The tubular cavity itself can be V-shaped, but it is preferred that a member which fits into the cavity and has a V-shaped cross-section is inserted in the tubular cavity. Thus, the material of the member can be selected independent from the material of the element for washing or treating a yarn, can be manufactured separately, and can be easily replaced during maintenance after all, the cavity through which the yarn travels will be subject to wear.

In a production environment several yarns run parallel, for instance just after extrusion and coagulation. Accordingly, the element of the present invention preferably comprises at least two parallel cavities. Of course, it is also possible to mount several elements each comprising only one cavity next to each other.

DETAILED DESCRIPTION OF PREFERRED EMBODIMENT

Figure 1:
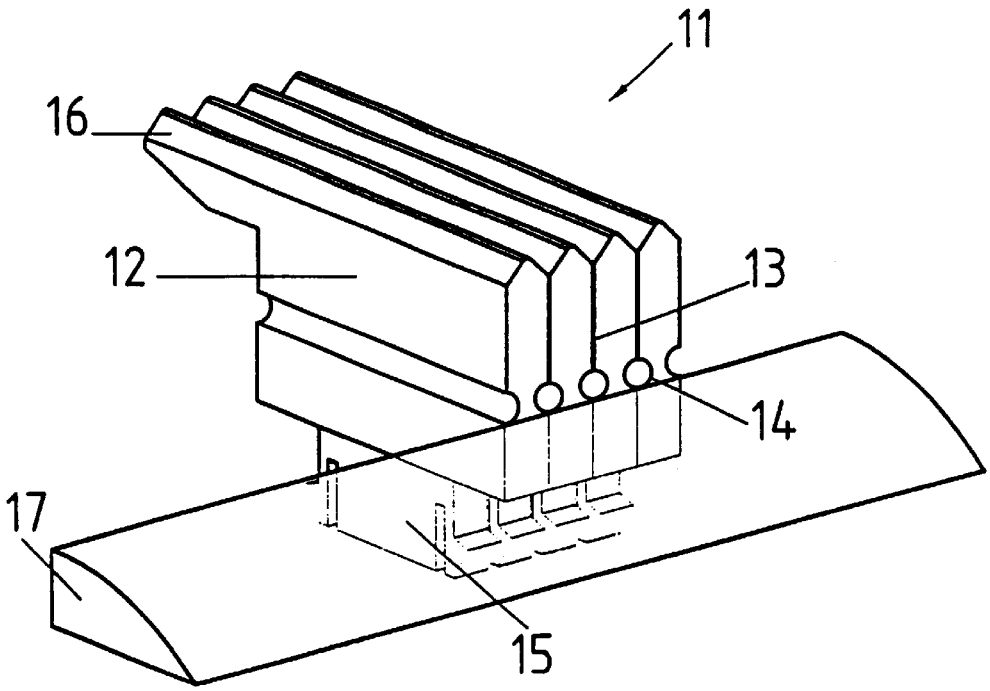
FIG. 1 shows a prospective view of a preferred embodiment of the present invention.
Figure 2:
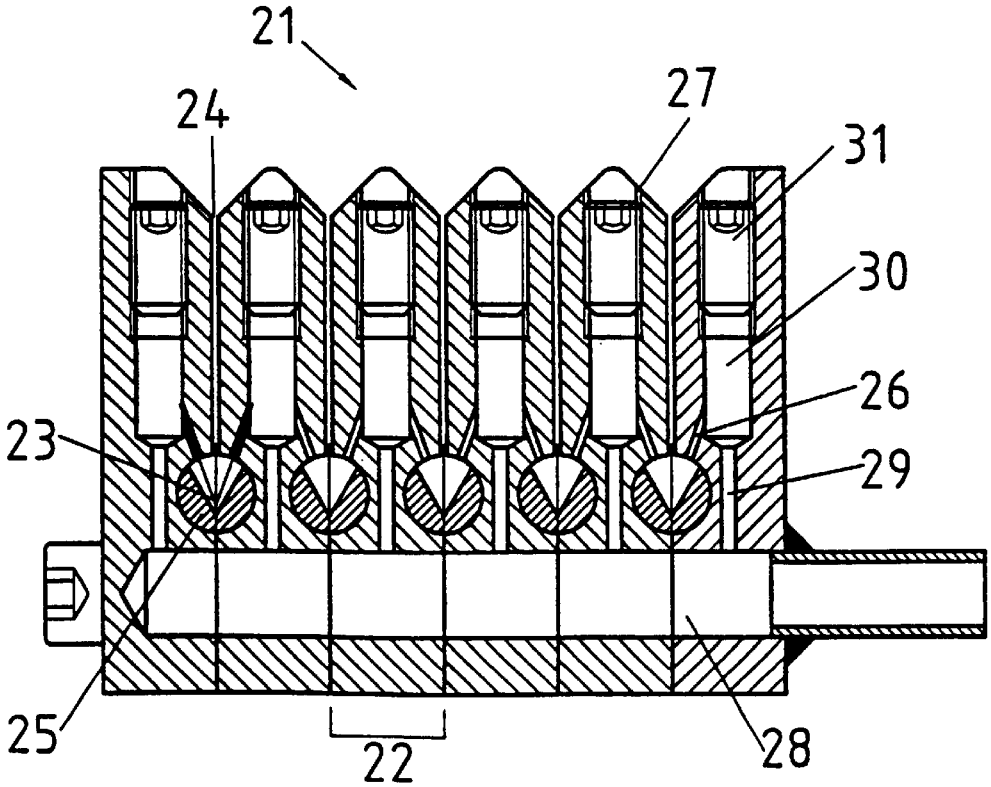
FIG. 2 shows a cross-section of the embodiment equipped with a V-cross-section ceramic insert.

FIG. 1 shows a perspective view of a preferred embodiment wherein the element 11 comprises building blocks 12 which are symmetrical with regard to a plane parallel to the slot 13 and which have approximately half of the cavity 14 and the slot 13 on both outer sides of the element parallel to the plane. The building blocks 12 are positioned next to each other, thus forming the cavities 14 and the conduits for the internal transport of the fluid. The positioning of the building blocks 12 can be done, e.g., by a snap-fit connection 15 of the building blocks 12 with a frame (not shown). The snap-fit connection 15 allows fast replacement of one or more defective building blocks 12 with new ones without the need to take the entire construction apart. Interruption of the washing or treating of the yarn is thus kept to a minimum amount of time.

The element 11 further comprises a protrusion 16 or "balcony" above the entrance of the cavities 14 which serves to capture fluid that clings to the yarn after it has left a first element and forms small droplets upon entrance of a second or further element. In order to improve the removal of the fluid after the yarn has left the element 11 a sloping ledge 17 is provided near the exit of the cavities 14.

The element can be made with advantage of a polymer because this allows the use of very accurate and inexpensive production technologies such as injection molding. The selection of a suitable polymer is mainly dependent on the fluid which is used in the washing or treating process and the material that is washed off the yarn. An example of a polymer suitable for a great many fluids and materials, including the more aggressive materials such as acids, is PEEK (polyetherether ketone).

As mentioned above, irrespective of the material of which the element is made, a tubular member (containing the appropriate openings for the jets) can be inserted into the cavity. This insert can be made of a material which, for instance, is hard and wear-resistant, e.g., a ceramic material.

The invention also pertains to a process for washing or treating a yarn or a similar structure using the element of the present invention. In a preferred embodiment the fluid output of the jets is selected so as to fill the slot for the greater part with the fluid.

The fluid mentioned above may be any fluid suitable for washing or treating a yarn or similar structure, but liquids are preferred. For example, it can be a chemical of any kind or water.

The term "yarn," which includes fibrous or fiber-like structures or the like, refers especially to an—optionally freshly prepared, e.g., spun—filament made of one or more synthetic polymers, regenerated or such like polymers, other conventional fiber-forming substances or natural fibers, which filament can be present as monofilament fiber, multifilament fiber or hollow fiber, as well as in the form of a strip or as fibrous yarn. The yarn may have been prepared by means of a dry spinning or a wet spinning process, i.e., from a melt or solution by extruding through a spinneret, or by means of a mechanical spinning process. The process according to the invention thus is especially suitable for lyocell yarns (e.g., Newcell®), rayon yarns (e.g., Cordenka®), other solvent spun cellulosic yarns, polyester yarns, nylon yarns, aramid yarns (e.g., PPDT such as Twaron®), carbon yarns, silica yarns, cotton yarns, porous and non-porous hollow fibers made of cellulosic or synthetic polymers also known to this end which optionally act as membranes, etc.

It is noted that GB 762,959 discloses a process similar to that disclosed in WO 93/06266, which has been discussed above. Neither the tubular cavity nor the slot is mentioned or suggested in GB 762,959, however.

For completeness' sake, it is also noted that U.S. Pat. No. 4,453,298 discloses a texturizing nozzle for synthetic filiaments which is openable and closeable to facilitate lacing up. The nozzle is not designed to extract substances from a running yarn but, instead, to entangle its filaments, which is a fundamentally different action.

The invention will now be illustrated by way of an unlimitative example.

EXAMPLE

1. Element A (according to the invention).

An element 21 for washing a yarn consists of six main building blocks 22 made of stainless steel forming five cavities 23 and five slots 24 in all. The cavities 23 are 40 mm long and have a diameter of 5.5 mm. In the cavities 23 grooved ceramic rods 25 have been inserted so as to render the cross-section of the cavities 23 V-shaped. The slots are 0.5 mm wide, 40 mm (element A1) or 10 mm (element A2) long, and 20 mm high. The slots 24 diverge near the outside of the element 27. The fluid jets 26 are pointed towards the vertex of the V of the cavities 23, make an angle of 40° with one another, and have a round cross-section with a diameter of 0.5 mm. The fluid is transported via the main inlet 28 and smaller conduits 29 to the cylindrical cavities 30, which are sealed by stops 31. From the cylindrical cavities 30 the fluid is injected into the cavities 23 by means of the jets 26.

2. Element B (comparative example).

The stainless steel element comprises two walls which are 2.5 mm apart. In between the walls and transverse to the travelling direction of the yarn two cylindrical, horizontal guides are mounted for guiding the yarn. The walls are both provided with a fluid jet having a round cross-section with a diameter of 0.5 mm. The fluid jets are positioned opposite to one another and make an angle of 180° with one another (i.e., they are in line with one another and both in the horizontal plane through which the yarn travels).

3. Washing of cellulose yarn using elements A1, A2, and B.

Four of the elements in series spaced 30 cm apart were used for washing freshly spun cellulose yarn consisting of 50 filaments and drenched with cellulose and NMMO dissolved in water (at substantially equal concentrations). Water having a temperature of 30 ° C. was used at a rate of 7 $dm^3/h$. The yarn speed was 400 m/min. The Table below gives the mass transfer coefficient ("mass t." in 1/s) obtained with each of the elements. "Improvem." (in %) gives the relative improvement of element A1 in comparison with element B.

TABLE

| Yarn titer dtex | mass t. A1 1/s | mass t. A2 1/s | mass t. B 1/s | Improvem. % |
|---|---|---|---|---|
| 55 | 8.14 | 6.32 | 5.53 | 47 |
| 75 | 5.58 | 4.90 | 3.64 | 53 |
| 110 | 6.25 | 3.92 | 3.25 | 92 |
| 150 | 2.81 | 2.51 | 2.40 | 17 |

These experimental results clearly show that the element according to the invention allows a considerable improvement of mass transfer to the washing fluid. Further, no aerosol was formed during the use of elements A1 and A2, whereas element B produced an unacceptable level of aerosol (which necessitated the use of various safety measures).

Reduction of the fluid flow rate (from 7 to 5 $dm^3/h$) did not substantially affect the mass transfer. Further, the spinning in of the yarn to the element A1 or A2 could be performed by simply inserting the yarn in a slot until a point below the jets was reached. After that the yarn was automatically pushed into the cavity where the positioning of the yarn happens automatically. To ensure positional stability for the yarn travelling through element B it was necessary to position the yarn above the first guide and below the second guide, which is a time-consuming operation, and even then the positional stability was not satisfactory.

The fact that the fluid jets in the elements A1 and A2 make a sharp angle (40°) with one another allows a very compact design of the elements.

What is claimed is:

1. An element for washing a yarn or similar structure with a washing fluid, the element at least comprising:

a cavity for guiding the yarn; and at least one fluid jet for directing the washing fluid into the yarn, wherein the cavity is tubed-shaped and communicates with the outside of the element via a slot, and the cross-section of the tubular cavity is one of V-shaped or is provided with a V-shaped insert with the vertex of the V pointing away from the at least one jet.

2. The element according to claim 1, wherein the slot runs the length of the cavity.

3. The element according to claim 1, further comprising at least two jets, forming an angle with one another of less than 90°.

4. The element according to claim 1, wherein the cavity and the slot are at least 8 mm long, and/or the slot has at least one dimension selected from the group consisting of at least 15 mm in height and a width is in a range from 0.3 to 4 mm.

5. The element according to claim 1, further comprising at least two parallel cavities.

6. The element according to claim 1, wherein the washing element comprises building blocks which are symmetrical with regard to a plane parallel to the slot and which have approximately half of the cavity and/or the slot on both outer sides of the element parallel to the said plane.

7. The element according to claim 6, wherein each building block is provided with means for a snap-fit connection with a frame or with each other.

8. A process for washing or treating a yarn or a similar structure using the element according to claim 3.

9. The process according to claim 8, wherein a fluid flow rate in the jets is selected so as to fill the slot for the greater part with the washing fluid.

10. An element for washing or treating yarn, comprising:

at least two building blocks;

a slot between two adjacent building blocks;

a circular cavity formed by opposing grooves formed in the two adjacent building blocks, the slot terminating in the circular cavity;

a fluid cavity formed in each building block;

at least one fluid jet extending from the fluid cavity to the circular cavity; and a fluid passage system feeding fluid to the fluid cavity.

11. The element according to claim 10, wherein an axis of the at least one fluid jet in one building block if extended would intersect an extension of an axis of a fluid jet in the adjacent building block at an angle in a range of 30 to 50°.

12. The element according to claim 11, wherein the angle of intersection is substantially 40°.

13. The element according to claim 12, further comprising an insert for mounting within the circular cavity, the insert having a V-shaped groove.

14. The element according to claim 10, further comprising an insert for mounting within the circular cavity, the insert having a V-shaped groove.

15. The element according to claim 14, wherein the angle of intersection has an apex at a vertex of the V-shaped groove.

16. The element according to claim 14, wherein the at least two building blocks have a length in a range of 10–40 millimeters.

17. The element according to claim 16, wherein the length is one of 10 and 40 millimeters.

18. The element according to claim 10, wherein the cavity and the slot are at least 8 mm long, and/or the slot has at least one dimension selected from the group consisting of at least 15 mm in height and a width is in a range from 0.3 to 4 mm.

19. The element according to claim 10, wherein a surface of each building block is beveled toward the slot such that a V-shaped groove is formed by the adjacent building blocks and centered on the slot.

* * * * *

UNITED STATES PATENT AND TRADEMARK OFFICE

CERTIFICATE OF CORRECTION

PATENT NO. : 6,270,532 B1 
DATED : August 7, 2001
INVENTOR(S) : Winfried Hölz, Heinz-Dieter Bauer and Hans-Dieter Kiaubs It is certified that error appears in the above-identified patent and that said Letters Patent is hereby corrected as shown below:

Title page,
Item [57], ABSTRACT,
Line 1, replace as follows: -- An element for washing or treating a yarn or similar structure with a fluid, the element comprising a cavity for guiding the yarn and at least one fluid jet for directing the fluid into the yarn. The cavity is tube-shaped and communicates with the outside of the element via a slot. With the element, the formation of aerosol is avoided and the consumption of the washing or treating fluid is halved. --

Column 1,
Line 46, change "herein below" to -- hereinbelow --; and
Line 48, change "above where the said, cavity is (substantially)" to -- above, where the cavity is substantially --.

Column 2,
Line 11, delete "said".

Signed and Sealed this

Nineteenth Day of November, 2002

*Attest:*

*Attesting Officer*

JAMES E. ROGAN
*Director of the United States Patent and Trademark Office*